US011519617B2

(12) United States Patent
Oddy

(10) Patent No.: US 11,519,617 B2
(45) Date of Patent: Dec. 6, 2022

(54) MODULAR VENT FOR METALLIC ROOFING

(71) Applicant: Ryan Oddy, Miles City, MT (US)

(72) Inventor: Ryan Oddy, Miles City, MT (US)

( * ) Notice: Subject to any disclaimer, the term of this patent is extended or adjusted under 35 U.S.C. 154(b) by 343 days.

(21) Appl. No.: 16/784,367

(22) Filed: Feb. 7, 2020

(65) Prior Publication Data

US 2020/0256568 A1 Aug. 13, 2020

Related U.S. Application Data

(60) Provisional application No. 62/803,395, filed on Feb. 8, 2019.

(51) Int. Cl.
*E04D 13/00* (2006.01)
*F24F 7/02* (2006.01)
*E04D 13/17* (2006.01)

(52) U.S. Cl.
CPC ..... *F24F 7/02* (2013.01); *E04D 13/17* (2013.01)

(58) Field of Classification Search
CPC ..... F24F 7/02; F24F 2221/16; F24F 2221/52; E04D 13/17; E04F 17/026
USPC ..... 454/35, 36, 366, 367
See application file for complete search history.

(56) References Cited

U.S. PATENT DOCUMENTS 4,270,232 A * 6/1981 Ballew ..... B65D 88/36 126/566
4,326,497 A * 4/1982 Guibert ..... F24C 15/322 126/261
4,344,646 A * 8/1982 Michel ..... E05B 65/5276 292/87
4,749,606 A * 6/1988 Moore ..... E04H 4/08 428/80
5,070,771 A 12/1991 Mankowski
5,411,163 A * 5/1995 Gueret ..... A45D 40/22 24/324
5,655,964 A * 8/1997 Rheault ..... F24F 7/02 454/368
5,921,863 A * 7/1999 Sells ..... E04D 13/174 454/359
6,015,343 A 1/2000 Castillo
6,052,956 A * 4/2000 Hoy ..... E04D 13/1475 52/200
6,155,008 A * 12/2000 McKee ..... E04D 13/0325 52/200
6,210,266 B1 * 4/2001 Barton ..... B60H 1/249 454/162

(Continued)

*Primary Examiner* — Ko-Wei Lin
(74) *Attorney, Agent, or Firm* — Michael C. Balaguy

(57) ABSTRACT

A vent assembly is adapted to be installed over an aperture in a roof to enable ventilation. The vent assembly has a roofing panel attachable to a roof and a vent cap with attaches over the roofing panel and prevents precipitation from entering the assembly. The roofing panel has a flat panel section, an aperture perforating the panel section, a fence bounding the aperture, and a runoff cricket formed by one corner of the triangularly-shaped fence. The vent cap has a chamfered triangular shape matching that of the fence. The vent cap includes a runoff cover and interior air passages to enable air to pass from an attic space through the roofing panel and out through the vent cap. The distinctive shape of the vent assembly provides advantages in easily installing the assembly to a variety of roofs, both metallic and non-metallic.

9 Claims, 5 Drawing Sheets

(56) References Cited

U.S. PATENT DOCUMENTS 6,263,624 B1 * 7/2001 Hoy ..... E04D 13/1475 52/200
6,286,273 B1 9/2001 Villela
6,669,553 B2 * 12/2003 Adams ..... F24F 13/24 454/252
7,827,816 B2 * 11/2010 Khan ..... B60H 1/3229 62/239
7,984,592 B1 * 7/2011 Jiras ..... B65D 88/741 52/302.1
8,181,403 B1 * 5/2012 Polston ..... F24F 13/082 52/198
8,205,401 B2 * 6/2012 Ward ..... F24F 7/02 52/302.1
8,246,726 B2 * 8/2012 Yano ..... H05K 5/0213 454/367
8,300,411 B2 * 10/2012 Tang ..... H05K 7/20172 415/214.1
D678,498 S * 3/2013 Proulx ..... D23/373
D705,418 S * 5/2014 Proulx ..... D23/373
9,080,779 B1 * 7/2015 Leonard ..... F24F 7/02
9,523,509 B2 * 12/2016 Baldwin ..... F24F 7/02
9,909,318 B2 * 3/2018 Nelson, Jr. ..... E04D 13/0315
10,415,252 B1 * 9/2019 Polston ..... F24F 7/02
10,487,512 B2 * 11/2019 Bourque ..... E04D 13/174
10,723,547 B2 * 7/2020 Forrest ..... E04D 13/17
10,746,421 B2 * 8/2020 Fiser ..... F24F 13/28
10,767,370 B2 * 9/2020 Reyburn ..... E04D 13/0325
11,180,919 B1 * 11/2021 Nelson, Jr. ..... E04D 3/30
2005/0044808 A1 * 3/2005 Prenn ..... E04D 13/03 52/200
2005/0130581 A1 * 6/2005 Dodge ..... F24F 7/02 454/366
2005/0233691 A1 * 10/2005 Horton ..... E04D 13/17 454/366
2007/0141975 A1 * 6/2007 Polston ..... F24F 7/02 454/365
2008/0070494 A1 3/2008 Henry
2009/0053990 A1 * 2/2009 McKee ..... F24F 7/02 454/275
2009/0173009 A1 * 7/2009 Garries ..... E05C 1/10 49/176
2010/0056038 A1 3/2010 Ramsay
2010/0109318 A1 * 5/2010 Mulligan ..... E04D 13/0409 428/596
2010/0184366 A1 * 7/2010 Hassenstab ..... F24F 13/20 454/367
2010/0257798 A1 * 10/2010 Ward ..... F24F 7/02 52/302.5
2012/0073239 A1 * 3/2012 Haines ..... F24F 7/02 454/367
2012/0276837 A1 * 11/2012 Aida ..... B41J 29/377 454/333
2012/0304567 A1 * 12/2012 Baker, IV ..... F24F 7/02 52/302.1
2013/0074428 A1 * 3/2013 Allen ..... E04D 13/174 52/302.1
2013/0078903 A1 * 3/2013 Mantyla ..... F24F 7/02 454/367
2014/0080404 A1 * 3/2014 Rodriguez, Jr. ..... F24F 7/02 454/366
2014/0099877 A1 * 4/2014 Gassman ..... E04D 13/178 454/366
2015/0167992 A1 * 6/2015 Bourque ..... F24F 7/02 454/365
2016/0053499 A1 * 2/2016 West ..... E04D 13/1476 52/218
2017/0146253 A1 * 5/2017 Mantyla ..... F24F 7/02
2018/0066858 A1 * 3/2018 Fiser ..... B01D 46/00
2018/0216845 A1 * 8/2018 Whitehead ..... F24F 13/10
2018/0312331 A1 * 11/2018 Forrest ..... E04D 13/17
2019/0145105 A1 * 5/2019 Reyburn ..... F24F 7/02 454/199
2019/0309521 A1 * 10/2019 Lutz ..... E04B 7/18
2020/0256568 A1 * 8/2020 Oddy ..... E04D 13/17

* cited by examiner

MODULAR VENT FOR METALLIC ROOFING

CROSS-REFERENCE TO RELATED APPLICATION(S)

The present application is related to and claims priority to U.S. Provisional Patent Application No. 62/803,395 filed Feb. 8, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of roofing of existing art and more specifically relates to roof ventilation art.

RELATED ART

Venting and circulation is a necessary element in modern homes. However, installing vents in existing structures can cause design and installation complications. When installing standard metal roof panels, a traditional turtle vent may not be suitable for use because of the ribs on the metal panels. Hail and other inclement weather can break and damage current metal and plastic vents. Further, traditional turtle vents can be problematic even when installed in non-metal roofs. The flat back of the vent can cause water pooling, and crickets which are installed by roofers may be poorly sealed in practice. Often, roofers installing turtle vents cause splits and voids in the shingles when attempting to seal them. The shape of traditional vents is boxy and inflexible. A suitable solution is desired.

U.S. Pat. No. 5,655,964 to Andre Rheault et al. relates to a static roof ventilator. The described static roof ventilator includes static ventilator made with three parts: 1) a hollow housing, triangular shaped with circumferential sidewalls and louvers attached to the outside walls, 2) a triangular shaped base fixed to the roof and 3) a cap at the top. The hollow housing is the part that actually does the ventilation. Each of its louvers is inclined downwards and out and comes with a piece of filter material preventing anything from entering the vent openings and allowing the air to circulate. The triangular shape of the hollow housing allows the wind to slide laterally along each side of the ventilator and prevents any snow or debris accumulation at the base and on the louvers of the ventilator. In order to secure the hollow housing to the roof surface, a triangular shaped piece serves as a base where the hollow housing is inserted. This base also lets the condensed water flow out of the hollow housing. The cap seals the hollow housing and prevents anything from falling straight into the ventilator. This reference is representative of roofing ventilation art.

SUMMARY OF THE INVENTION

In view of the foregoing disadvantages inherent in the known roofing ventilation art, the present disclosure provides a novel modular vent for roofing. The general purpose of the present disclosure, which will be described subsequently in greater detail, is to provide a modular vent for roofing.

A vent assembly is adapted to be installed over an aperture in a roof to enable ventilation. The vent assembly has a roofing panel attachable to a roof and a vent cap with attaches over the roofing panel and prevents precipitation from entering the assembly. The roofing panel has a flat panel section, an aperture perforating the panel section, a fence bounding the aperture, and a runoff cricket formed by one corner of the triangularly-shaped fence. The vent cap has a chamfered triangular shape matching that of the fence. The vent cap includes a runoff cover and interior air passages to enable air to pass from an attic space through the roofing panel and out through the vent cap. The distinctive shape of the vent assembly provides advantages in easily installing the assembly to a variety of roofs, both metallic and non-metallic. A particular advantage of the vent assembly is the shape and the built-in cricket which is integrated with the fence. This provides a structure which provides consistent runoff and is easy to seal to a variety of roofing structures, since sealing is not depending on workers cutting and forming shingles and metal roof panels around a separate cricket.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a modular vent for roofing, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to roofing ventilation and more particularly to a modular vent for roofing as used to improve the ease and cleanliness of installing of roofing vents to a variety of roof structures.

Generally, the disclosed system provides users with a modified vent used to provide ventilation to an attic space. The vent may include a triangular vent with a removable impact-resistant equilateral lid that can be painted to match any roofing product. Further, the vent may feature a built-in cricket section that allows for water runoff, preventing standing water from forming and causing damages. An element of the vent may also incorporate a structure similar to the ribs of metal roofing in order to increase the vent area, allowing users to effectively install a square static vent on a metal roof. This feature may allow users to mount the vent in numerous positions and with many different roofing materials.

The roofing vent assembly is a modified, triangular-shaped vent used to provide ventilation to an attic space in residential or commercial buildings. The triangular section may be equilateral in geometry and includes a removable impact-resistant lid. The lid can be painted to match any color roofing product. The corners of the triangular vent and lid may be chamfered. A built-in cricket allows for water runoff. The ribs of metal roofing panels are used to increase venting area. The vent solves the problem of not being able to install a square static vent on a metal roof. An additional screen keeps bugs, birds, and other rodents from entering the attic. Exact specifications of Static Vent may vary upon further development and manufacturing.

For the purpose of this specification, "downwardly" or "lower" indicates towards the side of the assembly which contacts the roof, and "upwardly" or "upper" indicates the opposite direction. "Outward" is radially outward from the center of the assembly, and "inward" indicates the opposite. "Cricket" is a term well known in the art used to indicate a projection, ridge, or pyramidal structure used to divert or direct water runoff. While geometry has varied in the art, the term is understood to fulfill this purpose.

Referring now more specifically to the drawings by numerals of reference, there is shown in FIGS. 1-4, various views of a vent assembly 100.

Figure 1:
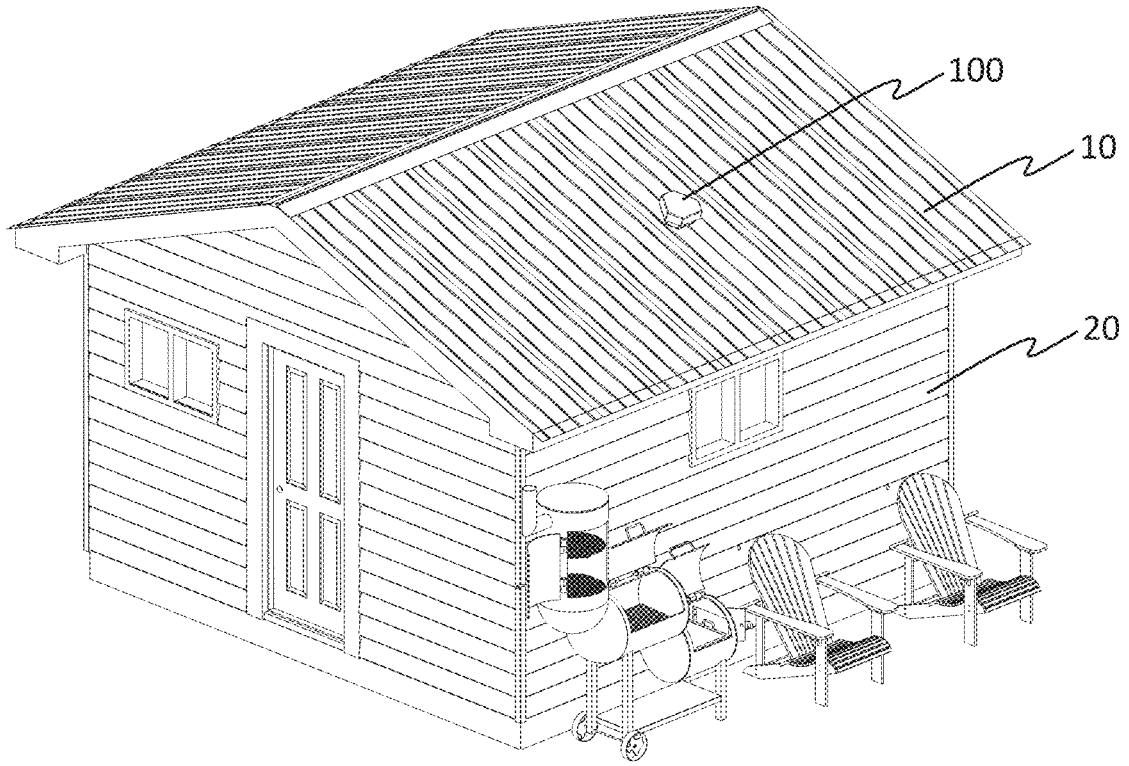
FIG. 1 is a perspective view of the vent assembly during an 'in-use' condition, according to an embodiment of the disclosure.

FIG. 1 shows a vent assembly during an 'in-use' condition, according to an embodiment of the present disclosure. Here, the vent assembly may be beneficial for use by a user to vent an interior of a structure to the atmosphere through the roof. As illustrated, the vent assembly 100 may be incorporated within a roof 10 on structure 20 for the purpose of venting the interior of structure 20 to the atmosphere. Roof 10 may be a metal roof, an asphalt-shingled roof, or other type of roof. Preferably, vent assembly 100 is constructed largely of sheet metal. While vent assembly 10 may be applicable to any type of roofing construction, it may be most advantageous in use with metal roofs.

Figure 2:
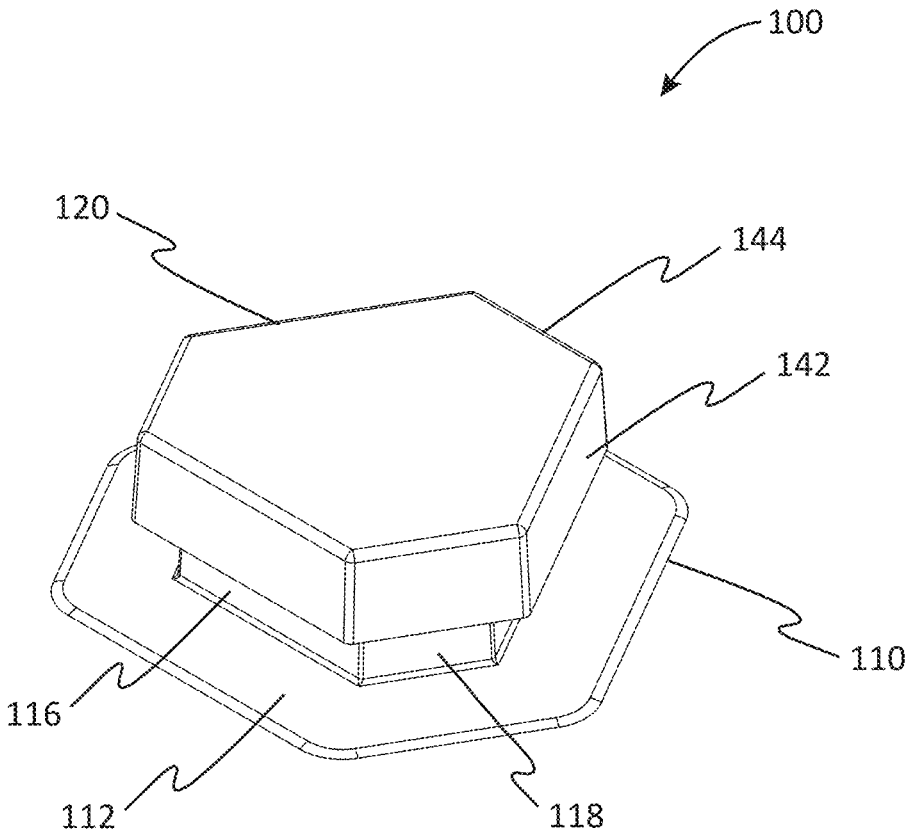
FIG. 2 is a top perspective view of the vent assembly of FIG. 1, according to an embodiment of the present disclosure.

FIG. 2 shows the vent assembly of FIG. 1, according to an embodiment of the present disclosure. As shown, vent assembly may include roofing panel 110 and vent cap 120. Roofing panel 110 may itself include panel section 110, aperture 112 (FIG. 5A), fence 116, and cricket 118. Panel section 112 may be a flat apron which, when installed, lies flat with roof 10 (FIG. 1). Roofing shingles and/or panels may be laid beneath and above panel section 112 to complete a water shedding roofing system. In some embodiments, panel section 112 may have a triangular shape with chamfered edges forming a six-sided perimeter as now illustrated. Each side 142 may meet each adjacent side at a chamfer 144. The three sides 142 may be equilateral, meeting each other at sixty-degree angles. Preferably, each chamfer 144 is at least twenty percent in length of each side 142. These components 142 and 144 may apply to the like triangular shape of each of panel section 112, fence 116, and vent cap 120. In the present figure, they are labeled with respect to vent cap 120. However, simplified embodiments may have a rectangular perimeter or a variety of other shapes.

Figure 5A:
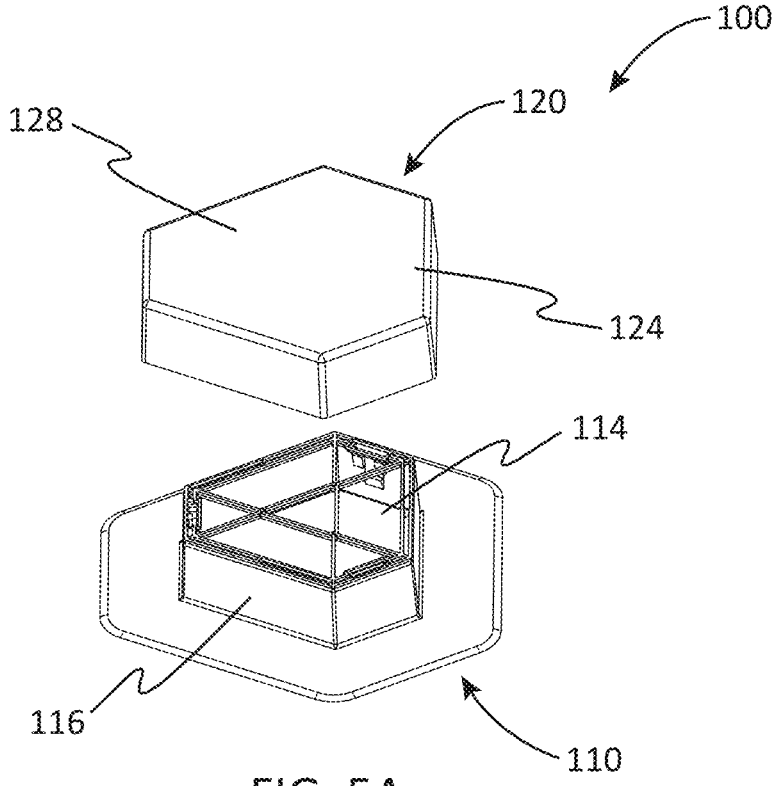
FIGS. 5A and 5B are perspective views of the vent assembly of FIG. 1 in a disassembled condition, according to an embodiment of the present disclosure.

Aperture 114 (FIG. 5A) perforates panel section 112 and when installed should be positioned over a corresponding opening in roof 10, as this enables the passage of air from an attic space underneath. Fence 116 may bound and circumscribe aperture 114 (FIG. 5A). Preferably, fence 116 is normal to panel section 112 at all points around aperture 114. This is preferred because it provides an air passage of consistent breadth and because it provides an external structure which vent cap 120 can slide down upon. However, other angles may be used so long as fence 116 is raised above panel section 112, which is necessary to raise vent cap 120 from roofing panel 110. Cricket 118 may be formed by one corner of fence 116. Cricket 118 fulfills a primary purpose in providing a watershed for runoff to be diverted to either the left or right of fence 116 when running down the roof, so that the runoff does not pool against fence 116 on an upper side. Fence 116 may take various perimeter shapes, but mostly preferably, fence 116 is concentric to and copies the shape of panel section 112. Any corner of fence 116 may form the cricket depending merely on how roofing panel 110 is oriented. For example, in the illustrated embodiment both panel section 112 and fence 116 are shaped as triangles with large chamfered corners. Yet further, vent cap 120 may be shaped similarly to panel section 112 in like manner.

Figure 3:
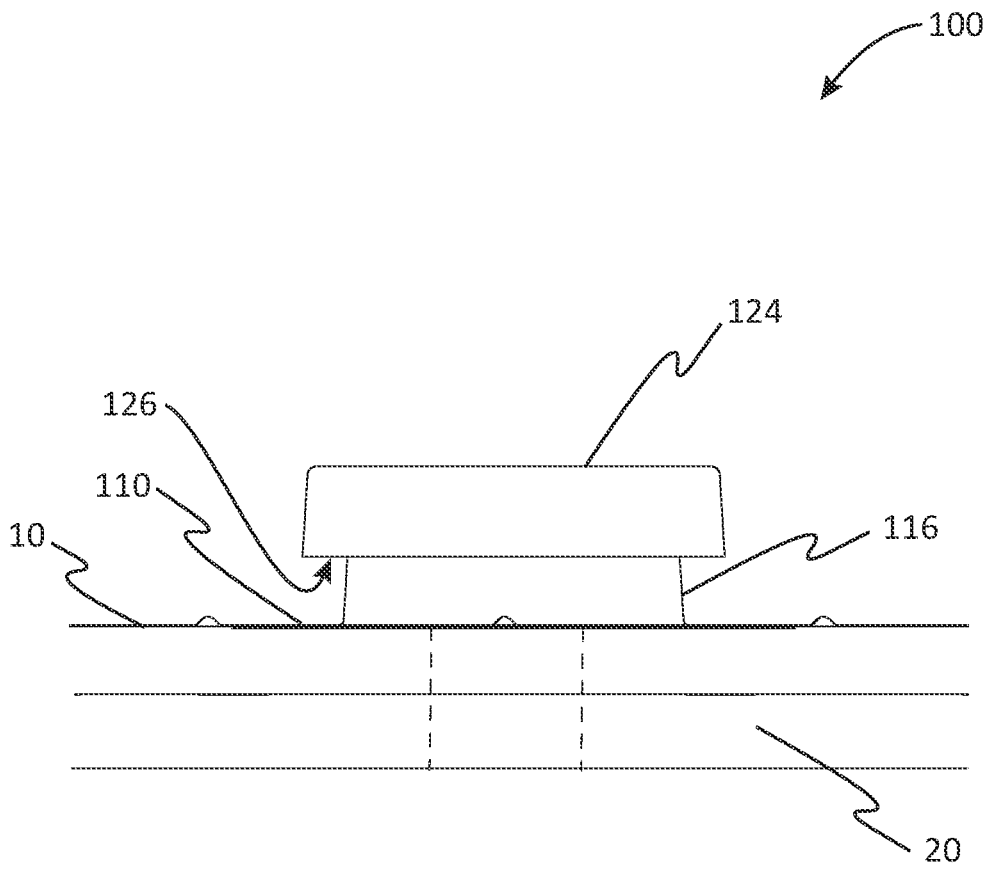
FIG. 3 is a side profile view of the vent assembly of FIG. 1, according to an embodiment of the present disclosure.

FIG. 3 is a side profile view of the vent assembly of FIG. 1, according to an embodiment of the present disclosure. As illustrated, vent cap 120 (FIG. 2) may include a top cover 124. Top cover 124 may be wider all the way around than fence 116 in order to prevent precipitation or other runoff to enter the interior of vent assembly 100 when running off of top cover 124. In some embodiments, vent cover 120 (FIG. 2) may have a neck extending down below cover 124 to mate over fence 116. However, in other, slimmer embodiments, top cover 124 may simply have a narrower recess within top cover 124. In any version, fence 116 is narrower than top cover 124, and is dimensioned such that is may be mated to vent cap 120 (FIG. 2) in order for form an air passage from the inside of structure 20 through roof 10 and through vent cap 120 (FIG. 2) into the surrounding environment. Also shown is roof panel 110 laid flat with and indexed to roof 10.

Figure 4:
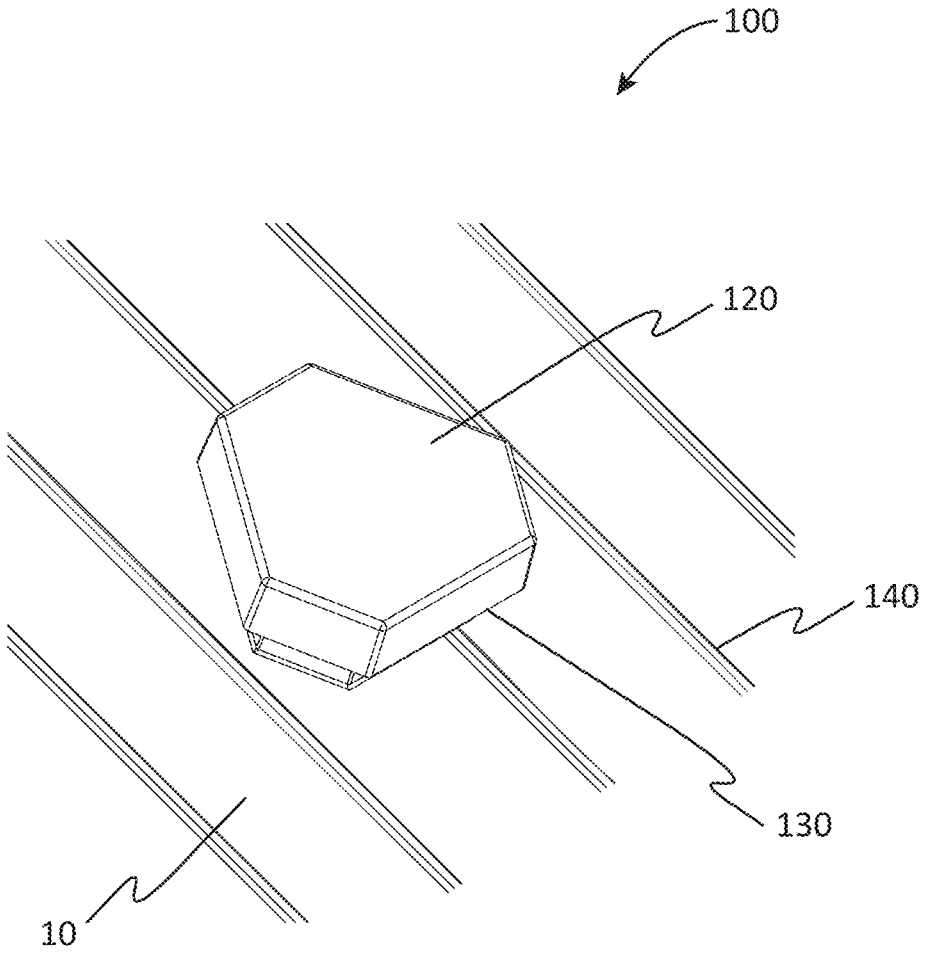
FIG. 4 is a top perspective view of the vent assembly of FIG. 1 installed on a metal roof, according to an embodiment of the present disclosure.

FIG. 4 is a top perspective view of the vent assembly of FIG. 1, according to an embodiment of the present disclosure. Vent assembly 110 is shown installed on roof 10. Also clearly illustrated is perimeter 130 of vent cap 120, which in the illustrated embodiment is substantially triangular with large chamfers on each corner. Roofing panel 110 may further comprise one or more bends 140 in the sheet metal of panel section 112, and therefore has a concave channel on the underside, and a convex ridge on the upperside. Please note that the use of "concave" and "convex" does not necessarily indicate a curvature for the purposes of this specification. In fact, in a preferred embodiment, each bend 140 is a formation having a ninety-degree edge in the center and forty-five-degree edges on either side where bend 140 meets panel section 112. These exact angles are not necessary, but the orthogonal edge in the center is most desired because it allows the underside of bend 140 to index with corresponding ridges in metal roofs. When installed with bend 140 nested over a ridge in a metal roofing panel, this provides a clean and seamless look, helps ensure the vent assembly 110 is installed flush and uncanted with respect to roof 10, and makes sealing vent assembly 110 to roof 10 very simple. In one exemplary embodiment, a bend 140 is centered on panel section 112, being aligned with cricket 118, and being bisected by aperture 114 (FIG. 5A). However, in some cases multiples of bend 140 may be disposed along panel section 112, especially if panel section 112 is large enough to necessitate multiples of bends 140 to properly index with commercially available metal roofing panels.

Figure 5B:
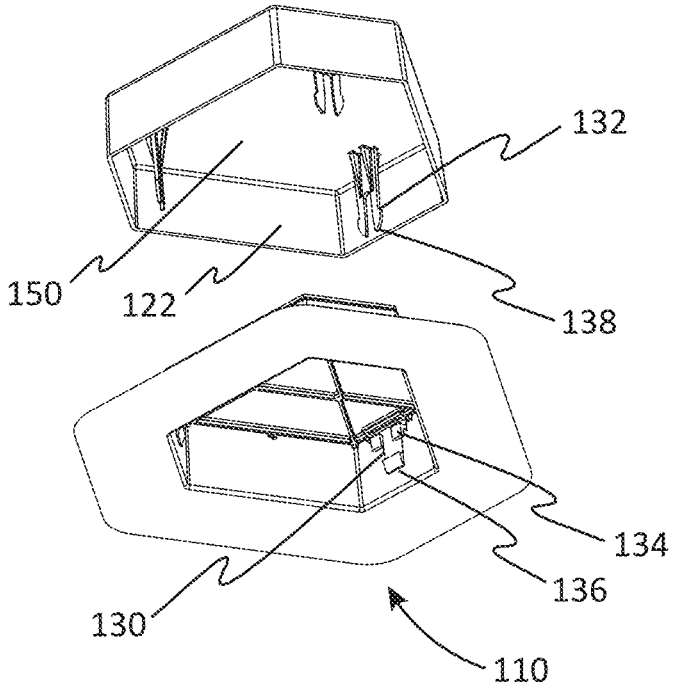

FIGS. 5A and 5B are perspective views of the vent assembly of FIG. 1 being divided into roofing panel 110 and vent cap 120, according to an embodiment of the present disclosure. Underside-opening 150 may be disposed underneath top cover 124 to enable air passage inside vent cap 120. Vent cap 120 may include aperture 114 as shown, enabling air to pass between an interior of structure 20 (FIG. 1) and the environment. Vent cap 120 may be fastenable to roofing panel 110 by a variety of means in differing embodiments. In the illustrated embodiment, clips are implements. In other embodiments, sheet metal screws may be used to fasten vent cap 120 to fence 116. Alternative solutions may be substituted.

As shown, vent cap 120 may incorporate at least one airgap 126 to enable air passage between the inside of vent assembly 100 to the outer atmosphere. In some embodiments, this is a perforation in the sheet metal (or other material) of vent cap 120. However, in other embodiments, at least one perforation may be formed by one or more separations between vent cap 120 and fence 116.

In some embodiments, roofing panel 110 may have at least on female-fastener 130 and wherein vent cap 120 further comprises at least one male-fastener 132 able to attach to at least one female-fastener 130 and retain vent cap 120 to roofing panel 110 as shown. Each one male-fastener 132 comprises two elastic clips 138. Each of the elastic clips 138 may include a catch, or shelf, or a tooth, or a barb which, when snap over a corresponding female fastener, act as retainers, as illustrated. Each female-fastener 130 comprises two ears 134 to which the two elastic clips 138 may attach. The elastic clips 138 may be released by finger pressure compressing the two elastic clips 138 together, such that the catch releases from the ear 134, and the two elastic clips 138 are able to pass through between the two ears 134. Each least one female-fastener 130 may also have a stop 136 against which each male-fastener 132 impinges, preventing overtravel of vent cap 120 down over fence 116. As the illustrated embodiment shows, the two ears 134 and the stop 136 may be arranged in a triangular fashion, which the two ears 134 being disposed at top left and right corners respectively of the female-fastener 130, and the stop 136 being positioned centrally in between but below the two ears 134. Female-fastener 130 is preferably disposed on an interior side of fence 116. Male-fastener 132 is preferably disposed interior to hollow channel 122.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A vent assembly comprising:

a roofing panel having a panel section adapted to integrate with a metal roof, an aperture perforating the panel section, a fence bounding the aperture, and a vent cap having an underside opening, a cover above the underside-opening having a closed top and wider dimensions than the underside-opening, enabling water to run off the vent cap without entering the underside-opening, wherein the cover is configured to attach about the fence of the roofing panel, and at least one airgap in an underside of the vent cap enabling air for freely passing from the aperture of the roofing panel through the underside-opening and out the at least one airgap;

wherein each of the closed top of the cover of the vent cap, the panel section of the roofing panel, and the fence of the roofing panel are hexagonal in shape having three sides of a first length and three sides of a second length interspersing the three side of the first length;

wherein the first length is greater than the second length; and wherein at least one of the three sides of the second length forms a cricket able to divert water runoff alongside the fence.

2. The vent assembly of claim 1, wherein the roofing panel further comprises at least one female-fastener and wherein the vent cap further comprises at least one male-fastener able to attach to the female-fastener and retain the vent cap to the roofing panel.

3. The vent assembly of claim 2, wherein the at least one male-fastener comprises two elastic clips.

4. The vent assembly of claim 3, wherein the at least one female-fastener comprises two ears to which the two elastic clips are configured to attach.

5. The vent assembly of claim 4, wherein the at least one female-fastener further comprises a stop against which the at least one male-fastener impinges, preventing overtravel of the vent cap down over the fence.

6. The vent assembly of claim 5, wherein each of the two ears and the stop are rectangular projections extending inwardly on an inner surface of the fence, and are triangularly arranged with respect to each other, with each of the two ears being disposed an upper right and left corners respectively, and the stop being positioned centrally between but downwardly from the two ears.

7. The vent assembly of claim 1, wherein the vent cap and the roofing panel each comprise sheet metal.

8. The vent assembly of claim 1, wherein the vent cap and the roofing panel each comprise plastic.

9. The vent assembly of claim 1, wherein the second length is over twenty-percent of the first length.

* * * * *